US009145755B2

(12) United States Patent
Farquhar

(10) Patent No.: US 9,145,755 B2
(45) Date of Patent: Sep. 29, 2015

(54) SEALING ANNULAR GAPS IN A WELL

(71) Applicant: HALLIBURTON ENERGY SERVICES, INC., Houston, TX (US)

(72) Inventor: Graham E. Farquhar, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/348,790

(22) PCT Filed: May 2, 2013

(86) PCT No.: PCT/US2013/039200

§ 371 (c)(1),
(2) Date: Mar. 31, 2014

(87) PCT Pub. No.: WO2014/178866

PCT Pub. Date: Nov. 6, 2014

(65) Prior Publication Data

US 2015/0129242 A1 May 14, 2015

(51) Int. Cl.

| | |
|---|---|
| ***E21B 33/12*** | (2006.01) |
| ***E21B 33/128*** | (2006.01) |
| ***E21B 23/06*** | (2006.01) |
| *E21B 33/00* | (2006.01) |

(52) U.S. Cl.

CPC ..... *E21B 33/1216* (2013.01); *E21B 23/06* (2013.01); *E21B 33/1208* (2013.01); *E21B 33/128* (2013.01); *E21B 2033/005* (2013.01)

(58) Field of Classification Search

CPC . E21B 2033/05; E21B 33/12; E21B 33/1208; E21B 33/1216; E21B 33/128; E21B 33/1285; E21B 33/1204

See application file for complete search history.

(56) References Cited

U.S. PATENT DOCUMENTS

| | | | | |
|---|---|---|---|---|
| 2,196,668 | A * | 4/1940 | Ragan | 166/122 |
| 3,227,462 | A * | 1/1966 | Tamplen | 277/333 |
| 3,784,214 | A * | 1/1974 | Tamplen | 277/341 |
| 4,349,204 | A | 9/1982 | Malone | |

(Continued)

FOREIGN PATENT DOCUMENTS

| | | |
|---|---|---|
| EP | 0828920 | 2/2003 |
| EP | 1503031 | 2/2005 |

(Continued)

OTHER PUBLICATIONS

International Search Report and Written Opinion of the International Searching Authority issued in International Application No. PCT/US2013/039200 on Feb. 5, 2014; 9 pages.

*Primary Examiner* — Blake Michener

(74) *Attorney, Agent, or Firm* — Scott Richardson; Fish & Richardson, P.C.

(57) ABSTRACT

A well tool for sealing against a wall of well includes an elongate mandrel. A seal assembly encircles the mandrel and can change between an unset state and an axially compressed set state. The seal assembly includes an annular elastomer seal element configured to radially deform into contact with the wall of the well in the set state. An annular anti-extrusion ring is included to compress the seal element and form a containing space with a garter spring embedded in the seal element. The garter spring is embedded in the seal element adjacent the axial end of the seal element and configured to span the gap between the anti-extrusion ring and the wall of the well in the set state. The containing space can prevent the seal element from excessive deformation.

17 Claims, 7 Drawing Sheets

(56) References Cited

U.S. PATENT DOCUMENTS

| | | | | |
|---|---|---|---|---|
| 4,379,558 | A * | 4/1983 | Pippert | 277/584 |
| 4,509,763 | A * | 4/1985 | Fischer | 277/342 |
| 5,165,703 | A | 11/1992 | Morvant | |
| 5,311,938 | A * | 5/1994 | Hendrickson et al. | 166/134 |
| 5,343,946 | A | 9/1994 | Morrill | |
| 5,433,269 | A * | 7/1995 | Hendrickson | 166/134 |
| 5,511,620 | A | 4/1996 | Baugh et al. | |
| 5,641,019 | A | 6/1997 | Stout et al. | |
| 5,791,657 | A * | 8/1998 | Cain et al. | 277/554 |
| 5,904,354 | A | 5/1999 | Collins | |
| 6,173,964 | B1 * | 1/2001 | Bell et al. | 277/584 |
| 8,083,001 | B2 | 12/2011 | Conner et al. | |
| 8,201,832 | B2 * | 6/2012 | Kocurek | 277/603 |
| 8,327,929 | B2 | 12/2012 | Reid et al. | |
| 2002/0043368 | A1 * | 4/2002 | Bell et al. | 166/118 |
| 2002/0195244 | A1 | 12/2002 | Coronado et al. | |
| 2005/0028990 | A1 * | 2/2005 | Atkins et al. | 166/387 |
| 2006/0186602 | A1 | 8/2006 | Martin et al. | |
| 2006/0243457 | A1 * | 11/2006 | Kossa et al. | 166/387 |
| 2007/0044977 | A1 * | 3/2007 | Hendrickson et al. | 166/387 |
| 2007/0056725 | A1 * | 3/2007 | Lucas et al. | 166/179 |
| 2008/0202771 | A1 * | 8/2008 | Carisella et al. | 166/387 |
| 2010/0071908 | A1 * | 3/2010 | Bishop et al. | 166/373 |
| 2010/0186970 | A1 * | 7/2010 | Burnett et al. | 166/387 |
| 2011/0114326 | A1 * | 5/2011 | Aubrey et al. | 166/338 |
| 2011/0266752 | A1 * | 11/2011 | Kocurek et al. | 277/322 |
| 2012/0006530 | A1 | 1/2012 | Crabb et al. | |
| 2012/0055667 | A1 * | 3/2012 | Ingram et al. | 166/65.1 |
| 2013/0234401 | A1 * | 9/2013 | Smith | 277/512 |

FOREIGN PATENT DOCUMENTS

| | | | | |
|---|---|---|---|---|
| GB | 2485004 | | 10/2013 | |
| WO | WO 2014/178866 | A1 * | 11/2014 | E21B 33/122 |

* cited by examiner

SEALING ANNULAR GAPS IN A WELL

CLAIM OF PRIORITY

This application is a U.S. National Stage of PCT/US2013/039200 filed on May 2, 2013.

BACKGROUND

This disclosure relates to sealing annular gaps in a well.

In a well, sealing tools, such as bridge plugs, frac plugs and packers, are used to isolate a zone and/or maintain a differential downhole pressure. An unset tool, whose seals are not yet expanded to seal, can be run down in the well's wellbore to a specific depth as part of a well string via tubing or wire. The sealing tool may then be actuated to expand the seals radially to a set state to seal the annular gap between the string and the well. When the seal is no longer needed, if the sealing tool is of a retrievable type, the sealing tool can be retrieved by retracting its seal from the set state back to the unset state.

SUMMARY

In a general aspect, a well tool for sealing against a wall of a well includes an elongate mandrel. A seal assembly encircles the mandrel and can change between an unset state and an axially compressed set state. The seal assembly includes an annular elastomer seal element that also encircles the mandrel. The seal element is configured to radially deform into contact with the wall of the well in the set state. An annular anti-extrusion ring is also included to encircle the mandrel. The anti-extrusion ring includes a first annular wall toward an axial end of the seal element and a second opposing annular wall. Both walls are configured to stand radially outward toward, but leaving a gap with, the wall of the well when the seal assembly is changed to the set state. A garter spring is embedded in the seal element adjacent the axial end of the seal element and configured to span the gap between the anti-extrusion ring and the wall of the well in the set state.

The well tool can include one or more of the following features. The first and second annular walls can define an interior annular cavity. The well tool can further include an elastomer ring encircling the mandrel. The elastomer ring can substantially fill the annular cavity. The well too can also include an annular wedge in the elastomer ring. The annular wedge encircles the mandrel and is constructed substantially of a more rigid material than the elastomer of the ring. In some implementations, the anti-extrusion ring and the annular wedge are made of metal.

In some specific aspects, the first and second annular walls form a non-zero angle with each other in the unset state. They can form an acute angle with each other when compressed in the set state. The garter spring can be filled with one or more metal balls. The garter spring can bridge a gap of 9.5 mm (0.375 in) or greater.

In some specific aspects, the anti-extrusion ring includes an annular shoulder oriented toward the second wall. The seal element can further include an annular shoulder oriented away from the second wall and engaging the annular shoulder of the anti-extrusion ring.

In some specific aspects, the well tool can include a setting sleeve carried to slide axially on the mandrel and compress the seal assembly between the unset state and the set state. An end of the anti-extrusion ring is engaged to the setting sleeve to move with the setting sleeve. The anti-extrusion ring is configured to grip the shoulder of the seal element with the shoulder of the anti-extrusion ring and axially expand the seal element when the setting sleeve is moved axially away from the seal element.

In some specific aspects, the seal element can include an annular groove on its outer surface. The groove is closed when the seal element is in the set state. The outer diameter of the seal element is at least 110% larger, and in some instances at least 120% larger, in the set state than the unset state. The anti-extrusion ring can be configured to compress radially from the set state toward the unset state when an axial force is applied near an outer diameter of the anti-extrusion ring.

The details of one or more embodiments are set forth in the accompanying drawings and the description below. Other features, objects, and advantages will be apparent from the description and drawings, and from the claims.

DESCRIPTION OF DRAWINGS

FIG. 2A illustrates a run-in state for running the bridge plug into the well. FIG. 2B illustrates a set state for sealing the annulus. FIG. 2C illustrates an equalizing state for releasing the bridge plug seal. And FIG. 2D illustrates a retrieving state for retrieving the bridge plug.

FIG. 3A illustrates the seal assembly in an unset state; and FIG. 3B illustrates the seal assembly in a set state.

Like reference symbols in the various drawings indicate like elements.

DETAILED DESCRIPTION

In certain instances, a sealing tool for sealing annular gaps in a well, for example, a bridge plug, frac plug, packer or other tool, can be a retrievable type, configured to be retrieved when the seal is no longer needed. The sealing tool includes a sealing assembly that can extend from an unset state to a set state to form a robust deformation-resistant structure to prevent seal failure due to high pressure or temperature over large annular gaps. If the sealing tool is a retrievable type, the sealing mechanism can also revert back to the unset state for retrieval. The sealing mechanism allows the sealing tool to seal a large annular gap, in certain instances, in bores of 110% or greater in diameter than the outer diameter of the well string.

Figure 1:
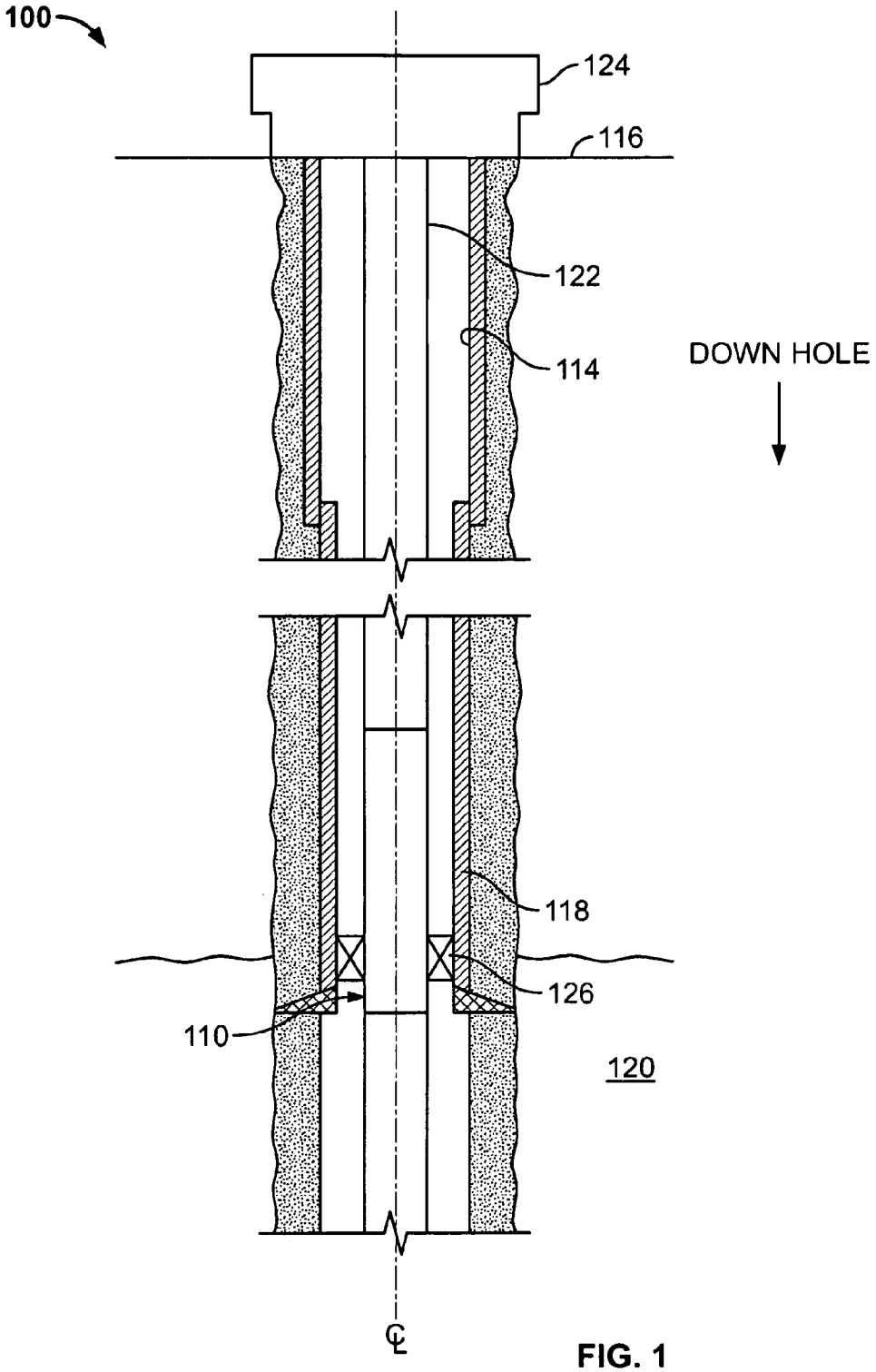
FIG. 1 is a schematic cross-sectional side view of a well system.

FIG. 1 is a schematic half cross-sectional side view of a well system 100. The well system 100 includes a wellbore 114 that extends from a terranean surface 116 into one or more subterranean zones 120. When completed, the well system 100 produces reservoir fluids and/or injects fluids into the subterranean zones 120. In certain instances, the wellbore 114 is lined with casing or liner 118. An example well sealing tool 110 is in a tubing string 122 that extends from a wellhead 124 into the wellbore 114. The tubing string 122 can be a coiled tubing and/or a string of joint tubing coupled end to end. For example, the tubing string 122 may be a working string, an injection string, and/or a production string. The scaling tool 110 can include a bridge plug, frac plug, packer and/or other sealing tool, having a seal assembly 126 for sealing against the wellbore 114's wall (e.g., the casing 118, a liner and/or the bare rock in an open hole context). The seal assembly 126 can isolate an interval of the wellbore 114 above the seal assembly 126 from an interval of the wellbore 114 below the seal assembly, for example, so that a pressure differential can exist between the intervals.

Figure 2A:
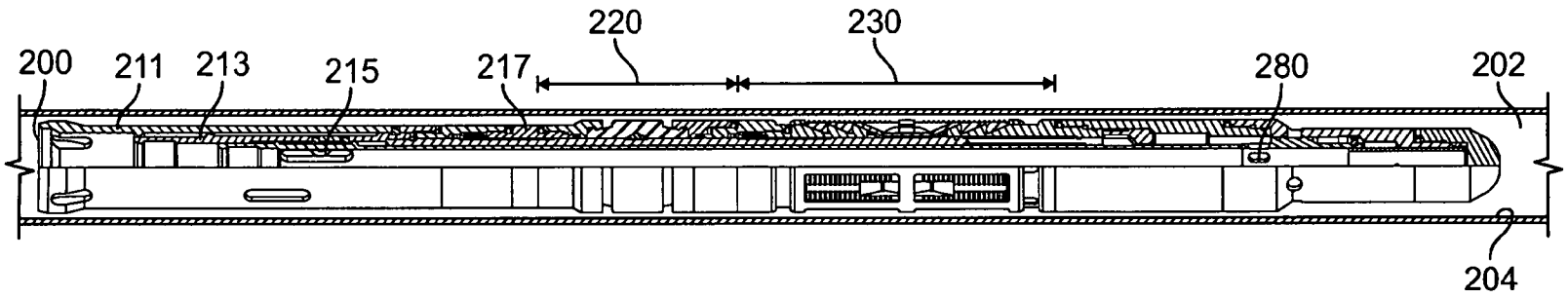
FIGS. 2A to 2D are quarter cross-sectional side views of an example retrievable bridge plug.
Figure 2B:
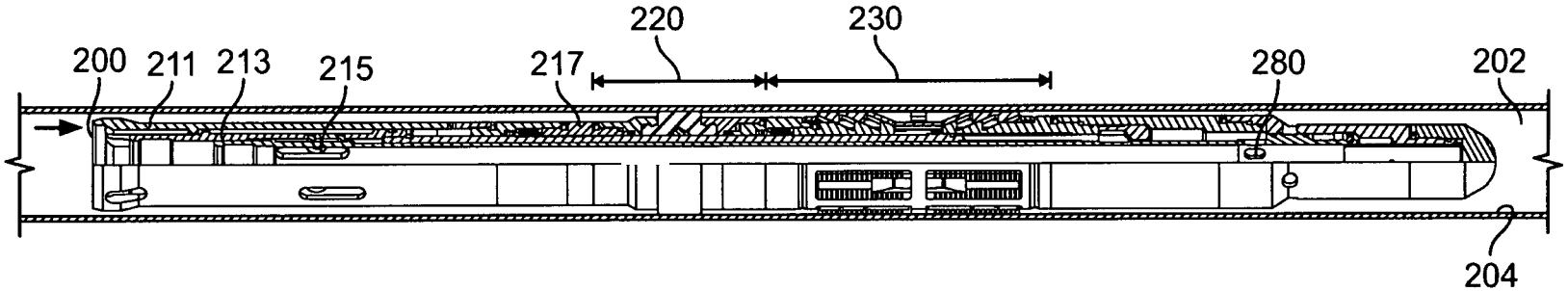
Figure 2C:
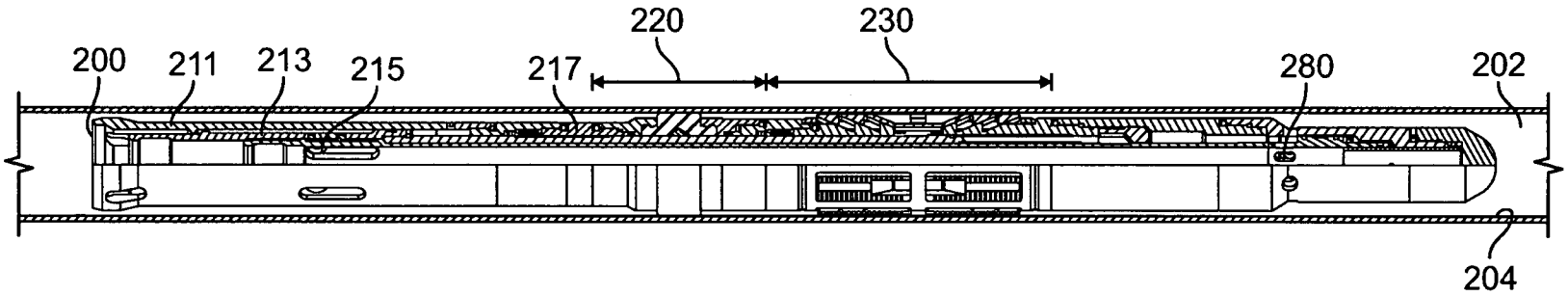
Figure 2D:
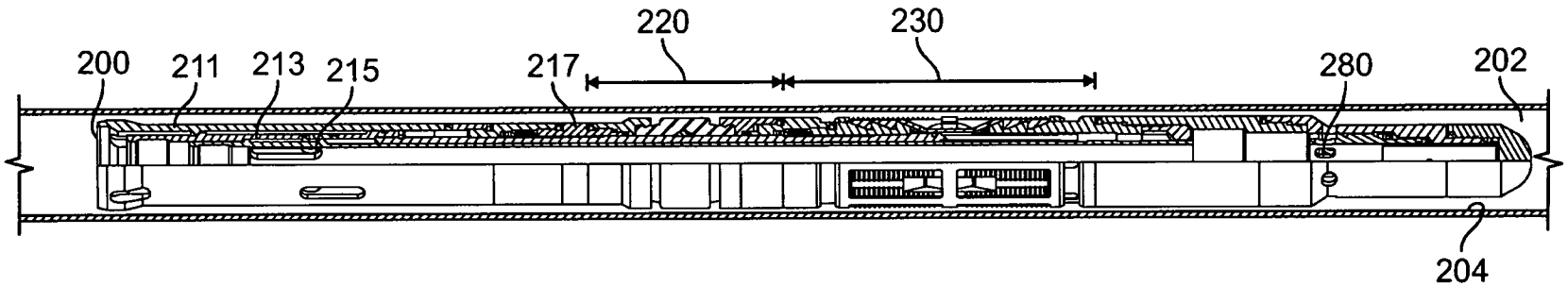

FIGS. 2A to 2D are quarter cross-sectional side views of an example retrievable bridge plug 200. FIG. 2A illustrates a run-in state for running the bridge plug into the well. FIG. 2B illustrates a set state for sealing the annulus. FIG. 2C illustrates an equalizing state for releasing the bridge plug seal, and FIG. 2D illustrates a retrieving state for retrieving the bridge plug. The bridge plug 200 can be used as the well sealing tool 110 in the well system 100 of FIG. 1. The bridge plug 200 can be run into the wellbore 202 to a specified depth on a setting tool via tubing (e.g., a coiled tubing, jointed tubing and/or other) or wire (e.g., wireline, slickline, and/or other), and actuated set to grip and seal the wellbore 202 (and the annulus between the bridge plug 200 and the wellbore wall 204). Thereafter, the setting tool and the tubing or wire can be disconnected from the bridge plug 200 and withdrawn to the terranean surface. In certain instances, the setting tool can be a standard, off-the-shelf setting tool. In other instances, the setting tool can be a proprietary setting tool and/or other tool. The bridge plug 200 is retrievable in that it can be re-engaged by a pulling/setting tool on tubing or wire and actuated unset to a retrieval state where it does not grip or seal with the wellbore wall 204 and can be withdrawn to the terranean surface.

Referring first to FIG. 2A, the bridge plug 200 enters the wellbore 202 in a run-in state. The bridge plug 200 includes a tubular setting sleeve 211, a tubular inner mandrel 213, a tubular equalizing sleeve 215, an annular seal assembly 220, and a slip assembly 230. In the context of a bridge plug (or frac plug), the downhole end of setting sleeve 211 is closed to passage of fluids into the interior center bore of the bridge plug 200. In other instances, the center bore can be open to allow passage of fluids through the bore, for example to or from other tools below. In the run-in state, the seal assembly 220 and the slip assembly 230 are radially compact (e.g., retracted and out of engagement with the wellbore wall 204) to facilitate running the bridge plug 200 into the wellbore 202. The uphole end of the setting sleeve 211, inner mandrel 213 and equalizing sleeve 215 include a profile adapted to be gripped with a setting tool. The inner mandrel 213 and setting sleeve 211 can be translated relative to one another with the setting tool to actuate the seal assembly 220 and the slip assembly 230. For example, comparing FIG. 2A (run-in state) to FIG. 2B (set state), the inner mandrel 213 has been translated uphole, to the left in FIG. 2B, relative to a portion 217 of the setting sleeve 211 to actuate the seal assembly 220 and the slip assembly 230 to the set state (the setting sleeve 211 is also translated downhole to the right in FIG. 2B). The seal assembly 220 is axially compressed by the setting sleeve 211 that, in turn, compresses and actuates the slip assembly 230.

In FIG. 2B, the set state of the bridge plug 200 is illustrated. In the set state, the seal assembly 220 and the slip assembly 230 are fully axially compressed and radially expanded. The seal assembly 220 is compressed between the setting sleeve 211 and the slip assembly 230 and radially expanded to contact and seal against the wellbore wall 204 and seal the annular gap between the bridge plug 200 and the wellbore 202. The slip assembly 230 is actuated to radially extend to grip the wellbore wall 204 and anchor the bridge plug 200 from axially moving relative to the wellbore 202.

In FIG. 2C, a pressure equalizing stage prior to retrieval of the bridge plug 200 is shown. The equalizing sleeve 215 is carried to translate inside the inner mandrel 213 to align one or more equalizing ports 280 of the sleeve 215 with equalizing ports 280 of the setting sleeve 211. When aligned, for example, via operation of a pulling tool, the equalizing ports 280 allow fluids to bypass the seal assembly 220 for equalizing pressure between the interior and exterior of the bridge plug 200, and thus uphole and downhole of the seal assembly 220. The equalized pressure relieves the seal assembly 220 and the slip assembly 230 from being axially loaded, allowing for retraction of the assemblies 220 and 230 and retrieval of the bridge plug 200. In FIG. 2D, the equalizing sleeve 215 is pulled uphole to retract the seal assembly 220 and the slip assembly 230.

Figure 3A:
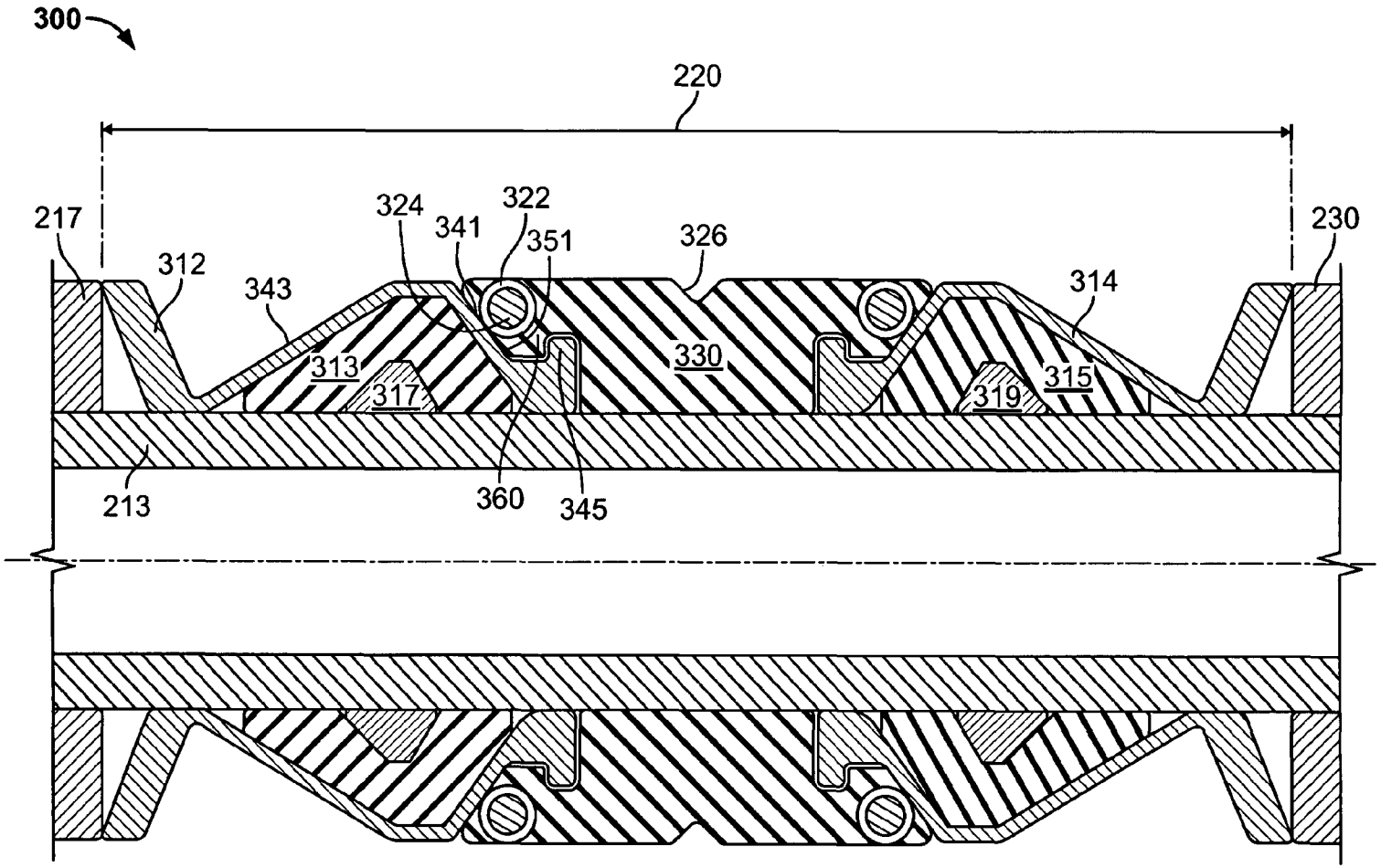
FIGS. 3A and 3B are detail cross-sectional side views of a seal assembly for the example bridge plug illustrated in FIG. 2A.
Figure 3B:
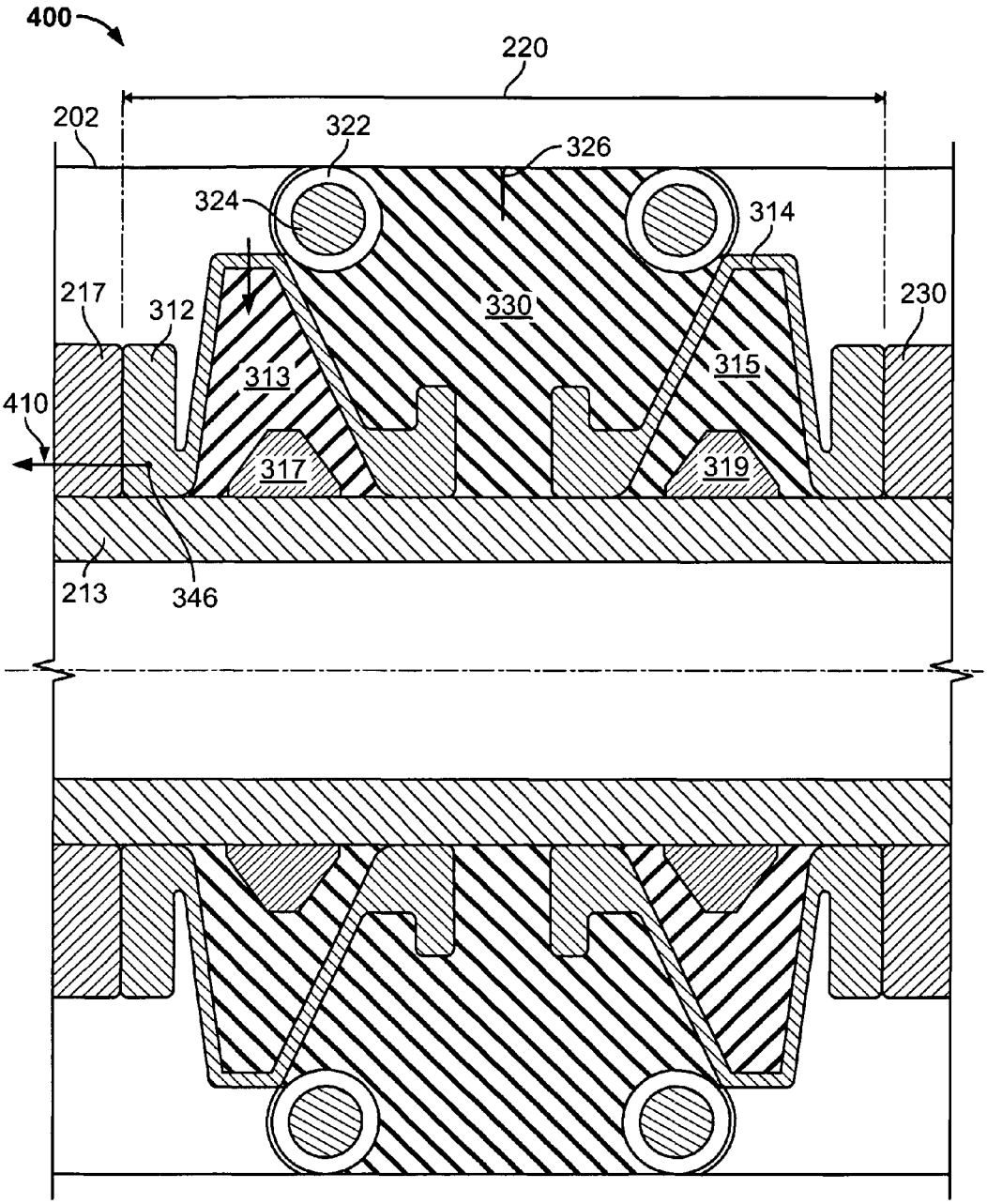

FIGS. 3A and 3B are detail cross-sectional side views of a seal assembly 220 for the example bridge plug 200 illustrated in FIG. 2A. The seal assembly 220, however, could also be used in other types of seal tools that axially compress the seal assembly 220 to set the seal assembly 220.

FIG. 3A illustrates the seal assembly 220 in an unset state, and FIG. 3B illustrates the seal assembly 220 in a set state. In FIG. 3A, the seal assembly 220 includes an elastomer seal element 330, a garter spring 322, and two anti-extrusion rings 312 and 314. The seal element 330 can be compressed between the two anti-extrusion rings 312 and 314 to expand radially for sealing the annular gap between the bridge plug 200 and the wall of the wellbore. The two anti-extrusion rings 312 and 314 can radially extend to axially support the seal element 330 from excessive deformation due to high pressures and/or prolonged exposure to high temperature. In the unset state 300, the elastomer seal element 330 and the anti-extrusion rings 312, 314 have not been compressed or deformed and they are radially compact. In the set state 400 (FIG. 3B), they are fully compressed and radially expanded to seal the annular gap between the bridge plug 200 and the wall of the wellbore 204. A garter spring 322 is embedded in the seal element 330 adjacent both the uphole and downhole axial ends of the seal element 330. As described below in FIG. 3B, the garter springs 322 span the gap between the anti-extrusion rings 312 and 314 and the wall of wellbore 202 when in the set state.

The seal element 330 is annular and encircles the inner mandrel 213. The seal element 330 can experience substantial deformation (e.g., radially expanded to over 110% of the original outer diameter) without failure (e.g., tear, wear, breakage, etc.) For example, the seal element 330 can be made of a viscoelastic material that has a low Young's modulus and a high yield strain, such as an elastomer or viscoelastic polymer. The elastomer or viscoelastic polymer can deform to fit a confined shape when a load is applied and return to the near original shape when the load is removed. For instance, the seal element 330 can be made of Butyl rubber, chloroprene rubber, polybutadiene, polyisoprene, nitrile rubber, or other material. The seal element 330 can further include an annular groove 326 on its outer surface, intermediate its ends. The grove 326 delays radial expansion of the seal element 330 by allowing the seal element 330 to initially fold inward (rather than radially deform) when compressed.

The anti-extrusion ring 312 encircles the inner mandrel 213. The anti-extrusion ring 312 can be compressed by a portion of the setting sleeve 217 that slides axially on the inner mandrel 213. In certain instances, the end of the anti-extrusion ring 312 is affixed to the portion of the setting sleeve 217, but in other instances it can be merely abutting the portion of the setting sleeve 217. The setting sleeve 217 slides toward the seal element 330 and anti-extrusion ring 312 axially compressing them both. The anti-extrusion ring 312 is made of metal, such as spring steel and/or another metal. It includes multiple annular walls (three shown) at non-zero angles to one another that fold when the anti-extrusion ring 312 is compressed. Particularly, an annular wall 341 is oriented toward an axial end of the seal element 330, and an annular wall 343 is oriented away from an axial end of the seal element 330. In the unset state shown in FIG. 3A, the annular walls 341 and 343 are radially compact and form a non-zero (acute or obtuse) angle with each other. The annular walls 341 and 343 are configured to stand radially outward toward, but leave a gap with, the wellbore wall 204 when axially compressed to the set state. Thus, when compressed to the set state, shown in FIG. 3B, the walls 341 and 343 move relative to one another to fold to an acute angle (near parallel) with each other.

The annular walls 341 and 343 define an interior annular cavity. An elastomer ring 313 fills the annular cavity. Upon compression, the elastomer ring 313 deforms with the anti-extrusion ring 312 to continue to fill the annular cavity as the cavity changes shape, and further operates in pushing the annular walls 341 and 342 to stand radially outward. The elastomer ring 313 can be made of the same or similar material as the seal element 330, such as Butyl rubber, and/or another material. In some implementations, an annular wedge 317 is included in the elastomer ring 313. The annular wedge 317 is made of a substantially more rigid material, such as metal and/or another material, than the elastomer ring 313. The annular wedge can slide on the inner mandrel 213, and due to its wedge shape, further operates in forcing the elastomer ring 313 to push the annular walls to stand radially outward.

The anti-extrusion ring 312 can further include a hook portion with an annular shoulder 345 oriented toward the wall 341. The seal element 330 includes a corresponding receptacle with annular shoulder 360 oriented away from the wall 341. The annular shoulder 360 engages the annular shoulder 345 of the anti-extrusion ring 312 linking the anti-extrusion ring 312 and seal element 330. The shoulders 345 and 360 can engage to pull when the seal assembly 220 is releasing from the set state to the unset state. For example, in releasing the plug to the unset state, the portion of the setting sleeve 217 is moved axially away from the seal element 330. The portion of the setting sleeve 217 pulls and axially expands (and radially retracts) the anti-extrusion ring 312. The anti-extrusion ring 312, in turn, is configured to grip the shoulder 360 of the seal element 330 with the shoulder 345 of the anti-extrusion ring 312 and further operates in axially extending (and radially retracting) the seal element 330 back toward the radially compact, unset state.

The anti-extrusion ring 314 is similar to the anti-extrusion ring 312 and is placed in a symmetrical position about the seal element 330. The anti-extrusion ring 314 also includes an elastomer ring 315 and an annular wedge 319. The anti-extrusion ring 314 abuts the seal element 330 on one side and is affixed to the slip assembly 230 on the other. During compression, the portion of the setting sleeve 217 moves the seal assembly 220 toward the slip assembly 230. The compression actuates the slip assembly 230 to radially expand toward the wellbore 202. The compression also compresses the seal element 330 between the anti-extrusion rings 314 and 312. When the slip assembly 230 fully grips onto the wellbore wall 204, the slip assembly 230 can function as a stop for the seal assembly 220 to allow for the seal element 330's full expansion. In unsetting the plug, the anti-extrusion ring 314 also grips a shoulder of the seal element 330 with a shoulder of the anti-extrusion ring 314 and further operates in axially extending (and radially retracting) the seal element 330 back toward the radially compact, unset state.

In FIG. 3B, the bridge plug 200 is fully axially compressed and radially expanded to form a seal with the wellbore wall 204. In certain instances in this set state 400, the outer diameter of the seal element 330 is at least 110% larger, and in some instances at least 120% larger, than the outer diameter of the seal element 330 in the unset state 300. The seal is realized by deforming the seal element 330 to fill a space created by the wellbore wall 204, the garter spring 322, the anti-extrusion rings 312 and 314, and the outer surface of the inner mandrel 213.

The garter spring 322 is configured to span the gap between the anti-extrusion ring 312/314 and the wellbore wall 204 and reinforce the seal element 330 against axial deformation through the gap between the anti-extrusion ring 312/314 and the wellbore wall 204. In some implementations, the garter spring 322 is filled with one or more metal balls 324. The metal balls 324 can provide further reinforcement against deformation of the seal element 320 through the gap. In some implementations, the garter spring 322 is configured to bridge a gap of 9.5 mm (0.375 inches) or greater, and in some instances, 12.7 mm (0.5 inches) or greater. In certain instances, the seal element 330 can When the bridge plug 200 is retrieved, the setting sleeve 211 and seal assembly 230 are pulled axially apart. The ends of anti-extrusion rings 312/314 move with the setting sleeve 211 and seal assembly 230 to axially expand, unfold and radially contract. The elastomer rings 313/315 tend to spring back to their initial axially expanded state and act on the anti-extrusion rings 312/314 to additionally operate in axially expanding the anti-extrusion rings 312/314. While the seal element 330 somewhat tends to spring back to its initial radially retracted state, the anti-extrusion rings 312/314 grip and axially pull on the seal element 330 to additionally operate in radially retracting the seal element 330.

As the plug 200 is being withdrawn from the wellbore, the seal assembly 220 resists hanging up on the interior of the wellbore. The annular walls of the anti-extrusion rings 312/314 present a ramped surface to any irregularities in the wellbore wall that tend not to grip or hang on the wall. For example, the annular wall 343 of the uphole extrusion ring 312, when retracted or partially retracted, forms an acute angle with the axial centerline of the plug and with the wellbore wall and defines an uphole facing ramped surface. Similarly, the annular wall 341 of the downhole extrusion ring 314, when retracted or partially retracted, forms an acute angle with the axial centerline of the plug and with the wellbore wall and defines another uphole facing ramped surface. If ramped surfaces contact the wellbore wall, they slide over the wall, including any irregularity, and guide the seal element 330 out of contact with the wall. Additionally contact with the wellbore wall applies force near an outer diameter of the anti-extrusion rings 312/314 that further pushes the anti-extrusion rings 312/314 radially inward and makes more clearance to pass irregularities. In instances where the anti-extrusion rings 312/314 are metal, the hard surface of the metal has low friction with the wellbore wall and can withstand multiple impacts.

A number of embodiments have been described. Nevertheless, it will be understood that various modifications may be made. Accordingly, other embodiments are within the scope of the following claims.

What is claimed is:

1. A well tool for sealing against a wall of a well, comprising:

an elongate mandrel;

a seal assembly encircling the mandrel, the seal assembly changeable while on the well tool between an unset state and an axially compressed, set state, the seal assembly comprising:

an annular, elastomer seal element encircling the mandrel and configured to radially deform into contact with the wall of the well when the seal assembly is changed to the set state;

an annular anti-extrusion ring encircling the mandrel and comprising a first annular wall toward an axial end of the seal element and a second, opposing annular wall, the first and second walls configured to stand radially outward toward, but leaving a gap with, the wall of the well when the seal assembly is changed to the set state;

a garter spring embedded in the seal element adjacent the axial end of the seal element and configured to span the gap between the anti-extrusion ring and the wall of the well when the seal assembly is changed to the set state;

where the first and second annular walls define an interior annular cavity;

an elastomer ring encircling the mandrel and substantially filling the annular cavity; and an annular wedge in the elastomer ring and encircling the mandrel, the annular wedge constructed substantially of a more rigid material than the elastomer of the ring.

2. The well tool of claim 1, where the anti-extrusion ring and the annular wedge comprise metal.

3. The well tool of claim 1, where in the unset state, the first and second annular walls form a non-zero angle with each other and in the set state, the first and second annular walls form an acute angle with each other.

4. The well tool of claim 1, where the garter spring comprises a metal ball filled garter spring.

5. The well tool of claim 1, where the garter spring is configured to bridge a gap of 0.375 inches (9.5 mm) or greater.

6. The well tool of claim 1, where the anti-extrusion ring comprises an annular shoulder oriented toward the second wall; and where the seal element comprises an annular shoulder oriented away from the second wall and engaging the annular shoulder of the anti-extrusion ring.

7. The well tool of claim 6, comprising a setting sleeve carried to slide axially on the mandrel and compress the seal assembly between the unset state and the set state; and where an end of the anti-extrusion ring is engaged to the setting sleeve to move with the setting sleeve and the anti-extrusion ring is configured to grip the shoulder of the seal element with the shoulder of the anti-extrusion ring and axially expand the seal element when the setting sleeve is moved axially away from the seal element.

8. The well tool of claim 1, where the seal element comprises an annular groove on its outer surface, where the groove is closed when the seal element is in the set state.

9. The well tool of claim 1, where the outer diameter of the seal element is at least 110% larger in the set state than the unset state.

10. The well tool of claim 1, where the anti-extrusion ring is configured to compress radially from the set state toward the unset state when an axial force is applied near an outer diameter of the anti-extrusion ring.

11. The well tool of claim 1, where the second annular wall of the anti-extrusion ring presents a ramped surface to the wall of the well.

12. A method, comprising:

sealing a wellbore with a seal assembly, the seal assembly encircling a mandrel and changeable between an unset state and an axially compressed, set state, the seal assembly comprising:

an annular, elastomer seal element encircling the mandrel and configured to radially deform into contact with the wellbore when the seal assembly is changed to the set state;

an annular anti-extrusion ring encircling the mandrel and comprising a first annular wall toward an axial end of the seal element and a second, opposing annular wall, the first and second walls configured to stand radially outward toward, but leaving a gap with, the wall of the well when the seal assembly is changed to the set state;

a garter spring embedded in the seal element adjacent the axial end of the seal element and configured to span the gap between the anti-extrusion ring and the wall of the well when the seal assembly is changed to the set state;

where the first and second annular walls define an interior annular cavity;

an elastomer ring encircling the mandrel and substantially filling the annular cavity; and where the elastomer ring contains an annular wedge encircling the mandrel, the annular wedge constructed substantially of a more rigid material than the elastomer of the ring.

13. The method of claim 12, where in the unset state, the first and second annular walls form a non-zero angle with each other and in the set state, the first and second annular walls form an acute angle with each other.

14. The method of claim 12, where the garter spring comprises a metal ball filled garter spring.

15. The method of claim 12, where the anti-extrusion ring comprises a hook; and where the seal element comprises a receptacle gripping the hook of the anti-extrusion ring.

16. The method of claim 15, where the seal assembly is compressed between the unset state and the set state with a setting sleeve carried to slide axially on the mandrel; and where an end of the anti-extrusion ring is engaged to the setting sleeve to move with the setting sleeve and the anti-extrusion ring is configured to axially expand the seal element when the setting sleeve is moved axially away from the seal element.

17. A sealing well tool system, comprising:

a wellbore;

a well tool moving inside the wellbore, the well tool having an elongate mandrel; and a seal assembly encircling the mandrel, the seal assembly changeable while on the well tool between an unset state and an axially compressed, set state, the seal assembly comprising:

an annular, elastomer seal element encircling the mandrel and configured to radially deform into contact with the wellbore when the seal assembly is changed to the set state;

an annular anti-extrusion ring encircling the mandrel and comprising a first annular wall toward an axial end of the seal element and a second, opposing annular wall, the first and second walls configured to stand radially outward toward, but leaving a gap with, the wall of the well when the seal assembly is changed to the set state; and a garter spring embedded in the seal element adjacent the axial end of the seal element and configured to span the gap between the anti-extrusion ring and the wall of the well when the seal assembly is changed to the set state;

where the first and second annular walls define an interior annular cavity;

an elastomer ring encircling the mandrel and substantially filling the annular cavity; and an annular wedge in the elastomer ring and encircling the mandrel, the annular wedge constructed substantially of a more rigid material than the elastomer of the ring.

* * * * *